US006174029B1

(12) United States Patent
Swy

(10) Patent No.: US 6,174,029 B1
(45) **Date of Patent: *Jan. 16, 2001**

(54) CHAIR WITH LEG REINFORCEMENT BAR

(75) Inventor: Philip P. Swy, Temperance, MI (US)

(73) Assignee: Michigan Tube Swagers & Fabricators, Inc.

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/985,728

(22) Filed: Dec. 5, 1997

(51) Int. Cl.[7] ..... A47C 3/04
(52) U.S. Cl. ..... 297/448.1; 297/239; 297/440.22
(58) Field of Search ..... 297/448.1, 239, 297/452.18, 445.1, 440.22

(56) References Cited

U.S. PATENT DOCUMENTS

| | | | | |
|---|---|---|---|---|
| 2,936,024 | * | 5/1960 | Hendrickson | 297/239 X |
| 2,961,037 | * | 11/1960 | Keefer | 297/239 |
| 2,981,319 | | 4/1961 | Close | 155/194 |
| 2,997,339 | * | 8/1961 | Wilson | 297/440.22 X |
| 3,025,105 | * | 3/1962 | Nash | 297/239 |
| 3,057,661 | * | 10/1962 | Moxley | 297/239 X |
| 3,102,733 | * | 9/1963 | Burnett | 297/239 X |
| 3,159,425 | * | 12/1964 | Engstrom | 297/239 X |
| 3,159,428 | * | 12/1964 | Schier | 297/239 X |
| 3,163,034 | * | 12/1964 | Midyette, Jr. | 297/239 |
| 3,203,731 | * | 8/1965 | Krueger | 297/239 |
| 3,273,922 | | 9/1966 | Rasor | 287/54 |
| 3,402,963 | * | 9/1968 | Fujioka et al. | 297/239 |
| 3,708,202 | * | 1/1973 | Barecki et al. | 297/239 |
| 3,795,923 | * | 3/1974 | Thomas | 297/440.22 X |
| 3,856,352 | * | 12/1974 | Jacobi, Sr. | 297/239 X |
| 4,057,288 | * | 11/1977 | Schwartz et al. | 297/239 |
| 4,067,606 | * | 1/1978 | Desmoulins Fouchereau et al. | 297/239 X |
| 4,105,250 | * | 8/1978 | Caldwell | 297/448.1 |
| 4,400,031 | * | 8/1983 | DeDecker | 297/239 |
| 4,807,929 | * | 2/1989 | Balsbaugh | 297/239 X |
| 5,524,963 | * | 6/1996 | Barile | 297/239 |
| 5,762,396 | * | 6/1998 | Barile | 297/239 |

FOREIGN PATENT DOCUMENTS

| | | | | |
|---|---|---|---|---|
| 216707 | * | 4/1958 | (AU) | 297/239 |
| 631966 | * | 12/1927 | (FR) | 297/239 |
| 1270997 | * | 7/1961 | (FR) | 297/440.22 |
| 2534463 | * | 4/1984 | (FR) | 297/440.22 |
| 638847 | * | 6/1950 | (GB) | 297/239 |
| 874793 | * | 8/1961 | (GB) | 297/239 |
| 912174 | * | 12/1962 | (GB) | 297/239 |
| 930158 | * | 7/1963 | (GB) | 297/239 |

* cited by examiner

*Primary Examiner*—Peter M. Cuomo
*Assistant Examiner*—Rodney B. White
(74) *Attorney, Agent, or Firm*—Gifford, Krass, Groh, Sprinkle, Anderson & Citkowski, P.C.

(57) ABSTRACT

A chair is formed to permit stacking when not in use and includes a pair of inverted substantially U-shaped leos joined together by a seat cushion and a back cushion supporting frame member. A leg reinforcement bar ties the U-shaped legs together and has an intermediate upwardly formed portion which engages the seat cushion along a line of contact to support the rear of the seat cushion.

6 Claims, 1 Drawing Sheet

CHAIR WITH LEG REINFORCEMENT BAR

FIELD OF THE INVENTION

The present invention relates to chairs and more particularly to a chair having a leg reinforcement bar which supports the seat of the chair while reinforcing the legs of the chair and still permitting a number of chairs to be snugly nested in a stacking relationship.

DESCRIPTION OF THE PRIOR ART

Chairs with legs in the form of an inverted U shape and in which the seat of the chair is supported by upper transversely extending portions of the U-shaped legs have been heretofore provided. In addition to the simplicity in construction of such chairs the main advantage is that they can be stacked one on top the other and they nest together to minimize the necessary storage room.

Generally the inclusion of a bar extending between the legs to support the seat at the rear of the chair interferes with the stacking of the chairs and thus substantially diminishes one of the important advantages of such chairs.

U.S. Pat. No. 2,981,319 to Close discloses a chair having a leg reinforcement bar which extends between the substantially U-shaped legs at the rear of the chair. The leg reinforcement bar is bent upwardly near its middle to provide essentially a point to point contact with the bottom of the seat.

SUMMARY OF THE INVENTION

The present invention provides a construction similar to the construction shown in the Close patent except that in the present invention the leg reinforcement bar has an upwardly formed portion which extends a substantial distance along the bottom of the seat to provide substantially the entire support for the rear of the seat. As will become apparent as the description of the preferred embodiment of this disclosure proceeds, the leg reinforcement bar of the present invention provides reinforcement for the legs of the chair while not interfering with stacking of the chairs and permitting the seat of the chair to be grasped to remove a chair from the stack.

BRIEF DESCRIPTION OF THE DRAWINGS

A better understanding of the present invention will be had upon reference to the following detailed description when read in conjunction with the accompanying drawings in which.

DETAILED DESCRIPTION OF A PREFERRED EMBODIMENT OF THE PRESENT INVENTION

Figure 1:
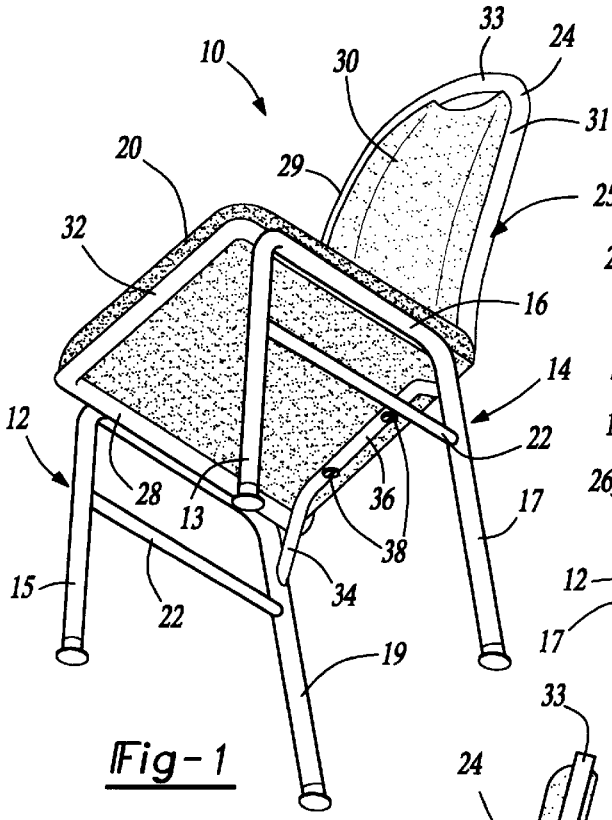
FIG. 1 is a perspective view of a preferred embodiment of the present invention.
Figure 2:
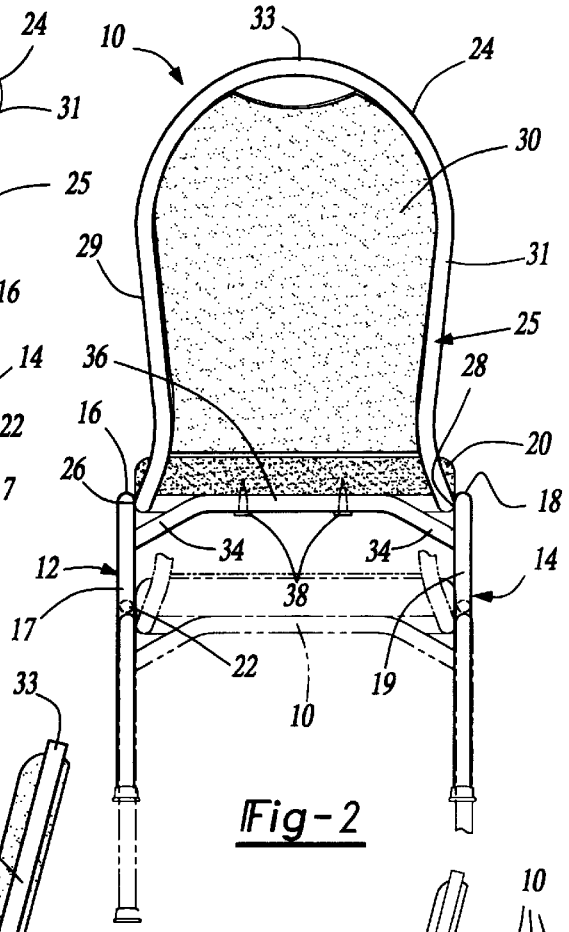
FIG. 2 is a rear elevational view of the chair shown by FIG. 1.
Figure 3:
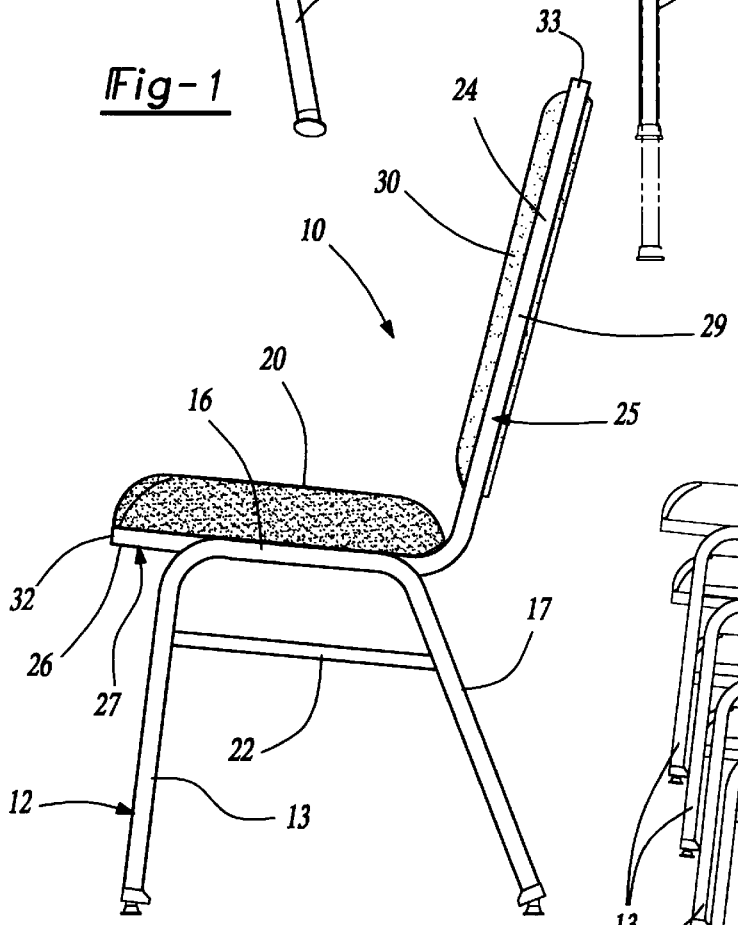
FIG. 3 is a side elevational view of the chair shown in FIG. 1.

With reference to the FIGS. 1, 2 and 3, a preferred embodiment of the present invention is illustrated and comprises a chair generally indicated at 10 and having a pair of opposed, substantially U-shaped legs or leg members 12 and 14. As can best be seen in FIG. 1 the legs 12 and 14 form an inverted U shape with the upper, substantially horizontally extending, portions 16 and 18 respectively of the legs 12 and 14. Still referring to FIG. 1, upper, substantially horizontally extending portions 22 extend between the front and rear leg portions 13, 15 and 17, 19 respectively of the U-shaped legs 12 and 14 respectively on each side of the chair 10 to provide support for the legs 12 and 14.

Still referring to FIGS. 1-3, a chair back frame member 24 is provided with horizontally extending side members 26, 28 respectively joined by welding or the like to the horizontally extending portions 16 and 18 of the legs 12 and 14. A substantially vertically extending section 25 of the frame member 24 provides the means for attaching a chair back cushion 30 to the chair 10. The side members 26 and 28 as well as a front member 32 which joins the side members 26 and 28 forms a substantially horizontal section 27 of the frame member 24 and provides support for a seat cushion 20. As can best be seen in FIGS. 1 and 2, the section 25 is formed by a pair of substantially vertically extending frame members 29, 31 joined by an upper frame member 33.

As can best be seen in FIGS. 1 and 2, a leg reinforcement bar 34 extends between the legs 12 and 14 near the rear of the seat cushion 20 and is joined to the legs 12 and 14 by welding or the like to join the legs 12 and 14 to each other and to thereby strengthen the chair 10 by resisting separation of the legs 12 and 14. The leg reinforcement bar 34 has an intermediate portion 36 which extends upwardly to engage and support the seat cushion 20. As can best be seen in FIG. 2, the intermediate portion 36 extends for a substantial portion of the length of the leg reinforcement bar 34 and is in engagement with the bottom of the seat cushion 20 over a substantial portion of the width of the seat cushion 20 to thereby provide support for the seat cushion 20. Screws 38 (FIG. 2) may be provided to securely attach the seat cushion 20 to the intermediate portion 36 of the leg reinforcement bar 34.

Figure 4:
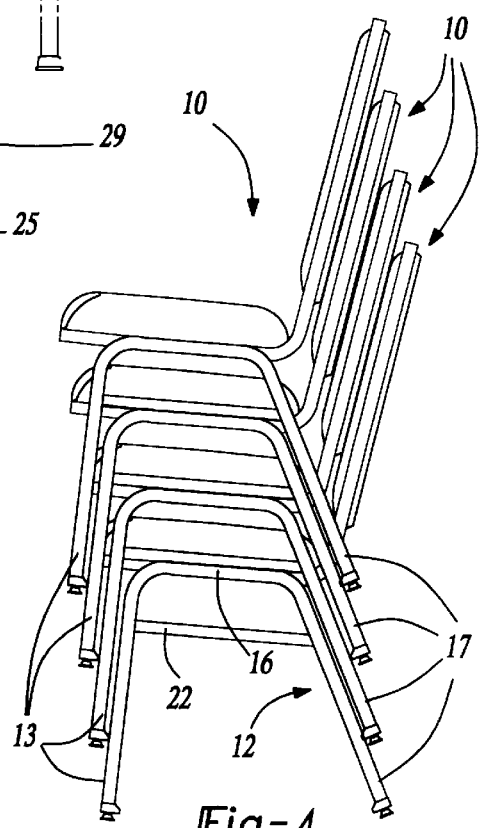
FIG. 4 is a side elevational view of a number of chairs of the present invention stacked for storage.

By forming the intermediate portion 36 in the manner shown in the drawings the leg reinforcement member 34 does not interfere with the stacking of a number of the chairs as can best be seen in FIG. 4. FIG. 2 shows in phantom, the position of a chair 10 when stacked below the chair 10 shown in full lines. Unlike the prior art not only does the leg reinforcement bar 34 provide support for the legs 12 and 14 but it provides support for the seat cushion 20 as well. Unlike the substantially point to point contact provided by the bar shown in the Close patent, for instance, which leads to tipping of the seat about the point to point contact, the leg reinforcement bar 34 of the present invention provides support for a substantial portion of the rear of the seat cushion 20 and therefore tipping of the seat cushion 20 is not a problem.

The position of the leg reinforcement bar 34 with respect to the bottom of the chair 10 is obviously quite important. The higher it is the closer the chairs 10 can be together when they are stacked. However, the leg reinforcement bar 34 provides a greater strengthening and reinforcing function when it is located closer to the floor. A straight bar located below the seat cushion will not be in a position to support the seat cushion.

The present invention by providing the upwardly formed portion 36 of the bar 34 is able to provide strength to the assembly without unduly interfering with stacking of the chairs. The bar 34 can be positioned sufficiently below the seat to adequately reinforce the legs of the chair. The bar is sufficiently high on the legs that it doesn't significantly interfere with stacking. The upwardly formed portion provides support for the rear of the seat cushion.

Having described my invention, however, it is apparent that many modifications can be made thereto without departing from the spirit of the invention as defined by the scope of the appended claims.

I claim:

1. A stackable chair of the type to be stacked atop a second substantially identical chair for storage purposes, said chair comprising:

a pair of substantially U-shaped leg members, said leg members being inverted to each provide a front leg portion and a rear leg portion joined by an upper, substantially horizontally extending portion, a frame member joined to said pair of leg members to form a substantially horizontal portion and a substantially vertically extending back portion, each said portion being supported by said leg members;

a seat cushion resting on and supported by said horizontal portion of said frame member and a back cushion supported by said substantially vertically extending portion of said frame member, a leg reinforcement bar extending between said rear leg portions and joined thereto beneath the rear portion of said seat cushion;

said leg reinforcement bar having an upwardly formed, substantially horizontal intermediate portion extending for a substantial portion of the length of said leg reinforcement bar and engaging and supporting said rear portion of said seat cushion along substantially the entire length of said upwardly formed intermediate portion, opposite ends of said leg reinforcement bar extending downwardly and angularly from said upwardly formed intermediate portion and abutting said rear leg portions; and said reinforcement bar being situated in such a manner so as to not come into direct contact with the second chair when said chair is stacked on top of the second chair in a manner such that said chair is nested on top of the second chair in the same directional orientation wherein the back portion of said chair abuts against the back portion of the second chair.

2. The chair as defined in claim 1 and in which said horizontal portion of said frame member comprises a pair of spaced horizontally extending side members joined by a front member with said side members being respectively joined to said horizontally extending portions of said leg members along the length thereof.

3. The chair as defined in claim 1 and in which said vertically extending portion of said frame member comprises a pair of spaced substantially vertically extending frame members joined by an upper frame member.

4. The chair as defined in claim 1 and including fastening means securing said seat cushion to said upwardly extending intermediate portion.

5. The chair as defined in claim 1 and in which said leg reinforcement bar is mounted to said rear leg portions of said frame members in a position closely adjacent said seat cushion.

6. A stackable chair of the type to be stacked with a plurality of other substantially identical chairs for storage purposes with each chair in the stack facing in the same direction and the backs of each of the chairs being adjacent one another, said chair comprising:

a pair of substantially U-shaped leg members that are inverted to each provide a front leg portion and a rear leg portion joined by an upper, substantially horizontally extending portion;

a frame member joined to said pair of leg members, said frame member having a substantially horizontal portion joined to said substantially horizontally extending portion of said leg members, said frame member further having a substantially vertically extending back portion;

a seat cushion resting on and supported by said horizontal portion of said frame member and a back cushion supported by said substantially vertically extending portion of said frame member; and a leg reinforcement bar extending between said rear leg portions and joined thereto beneath the rear portion of said seat cushion, said leg reinforcement bar having an intermediate substantially straight portion extending for a substantial portion of the length of said leg reinforcement bar and engaging and supporting said rear portion of said seat cushion along substantially the entire length of said intermediate portion, said leg reinforcement bar having a pair of ends extending downwardly from said intermediate portion and joining said leg portions.

* * * * *

UNITED STATES PATENT AND TRADEMARK OFFICE

CERTIFICATE OF CORRECTION

PATENT NO. : 6,174,029 B1
DATED : January 16, 2001
INVENTOR(S) : Philip P. Swy

It is certified that error appears in the above-identified patent and that said Letters Patent is hereby corrected as shown below:

Title page,
Item [57], ABSTRACT,
Line 2, replace "loes" with -- legs --.

Column 4,
Line 42, after "downwardly" insert -- and angulary --.

Signed and Sealed this

Eleventh Day of June, 2002

*Attest:*

*Attesting Officer*

JAMES E. ROGAN
*Director of the United States Patent and Trademark Office*